US006385989B1

(12) United States Patent
Cassidy

(10) Patent No.: US 6,385,989 B1
(45) Date of Patent: May 14, 2002

(54) COOLANT DELIVERY DEVICE

(75) Inventor: Thomas P. Cassidy, North Grosvenordale, CT (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 09/818,164

(22) Filed: Mar. 27, 2001

Related U.S. Application Data

(60) Provisional application No. 60/211,679, filed on Jun. 15, 2000.

(51) Int. Cl.[7] ..... F25D 17/02; B21B 27/06

(52) U.S. Cl. ..... 62/373; 72/201

(58) Field of Search ..... 62/373, 374, 64; 72/201; 239/559

(56) References Cited

U.S. PATENT DOCUMENTS

| | | | | |
|---|---|---|---|---|
| 1,278,617 A | | 9/1918 | V. E. Edwards | |
| 3,372,916 A | * | 3/1968 | Prescott et al. | 239/559 |
| 3,998,084 A | * | 12/1976 | Rerecich | 72/201 |
| 4,403,492 A | * | 9/1983 | Hope | 72/201 |
| 4,418,559 A | * | 12/1983 | Huzyak | 72/201 |
| 4,439,991 A | * | 4/1984 | Muzak | 62/63 |
| 4,577,482 A | * | 3/1986 | Greenberger | 72/201 |
| 4,706,485 A | | 11/1987 | Gilvar et al. | |
| 5,046,347 A | * | 9/1991 | Crosato et al. | 72/201 |
| 5,212,975 A | * | 5/1993 | Ginzburg | 72/43 |
| 5,855,134 A | * | 1/1999 | Womelsdorf et al. | 72/201 |
| 6,006,574 A | * | 12/1999 | Armenat et al. | 72/201 |

FOREIGN PATENT DOCUMENTS

GB 1281404 7/1972

OTHER PUBLICATIONS

Patent Abstracts of Japan, vol. 1998, No. 10, Aug. 31, 1998, JP10137822.

Patent Abstracts of Japan, vol. 005, No. 068, May 8, 1981, JP56019911.

* cited by examiner

*Primary Examiner*—William C. Doerrler

(74) *Attorney, Agent, or Firm*—Samuels, Gauthier & Stevens

(57) ABSTRACT

An apparatus is disclosed for applying a fluid coolant to the surface of rotating work roll in a rolling mill. The apparatus includes a housing having a generally concave inner edge configured and dimensioned to partially surround the surface of the work roll. The housing is subdivided into mating half sections having abutting interior surfaces. First grooves in the abutting interior surfaces are arranged in a confronting relationship to define a manifold conduit and second grooves in the same interior surfaces are arranged in a confronting relationship to define nozzle conduits leading from the manifold conduit to the concave inner edge of the housing. An inlet is provided in the housing through which a fluid coolant may be fed to the manifold conduit for application via the nozzle conduits to the surface of the work roll.

6 Claims, 3 Drawing Sheets

COOLANT DELIVERY DEVICE

This application claim benefit to provisional 60/211,679 filed Jun. 16, 2000.

BACKGROUND OF THE INVENTION

1. Field of the Invention

This invention relates generally to coolant delivery devices, and is concerned in particular with coolant delivery devices of the type employed to cool work rolls in a rolling mill.

2. Description of the Prior Art

Conventionally, rolling mill coolant delivery devices are fabricated from pipes which are bent into the desired configuration and then drilled at various angles to accommodate smaller tubes defining delivery nozzles. Such bending and drilling procedures make it difficult to achieve accuracy and repeatability, thus compromising cooling efficiency while contributing disadvantageously to high production costs.

SUMMARY OF THE INVENTION

The present invention addresses these problems by providing an improved coolant delivery device subdivided into two mating half sections. Each half section is accurately machined with manifold and branch delivery grooves which coact when the half sections are assembled to provide an efficient coolant delivery system.

These and other features and advantages of the invention will now be described in greater detail with reference to the accompanying drawings, wherein:

DETAILED DESCRIPTION OF PREFERRED EMBODIMENT

Figure 1:
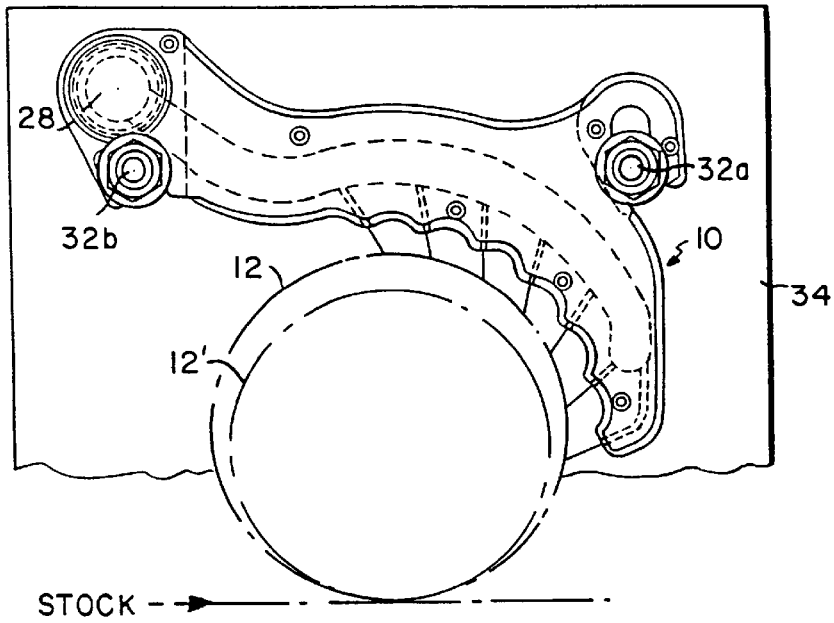
FIG. 1 is a side elevational view of a coolant delivery device in accordance with the present invention; shown in an operative position adjacent to a rolling mill work roll.
Figure 2:
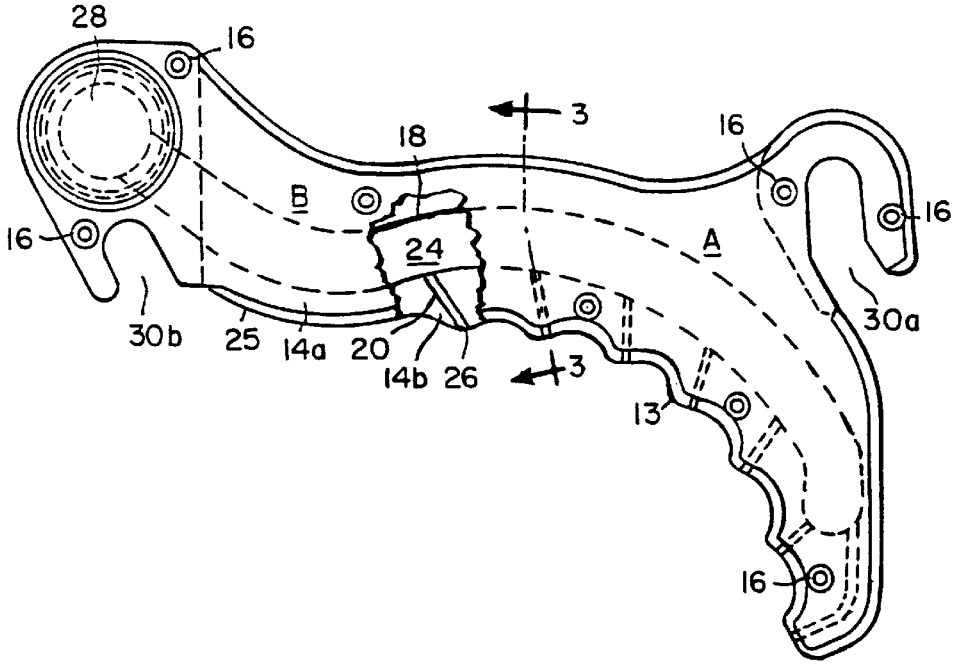
FIG. 2 is an enlarged partially broken away side view of the coolant delivery device.
Figure 3:
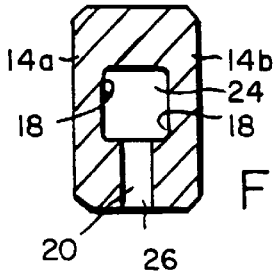
FIG. 3 is a cross sectional view taken along line 3—3 of FIG. 2.
Figure 4:
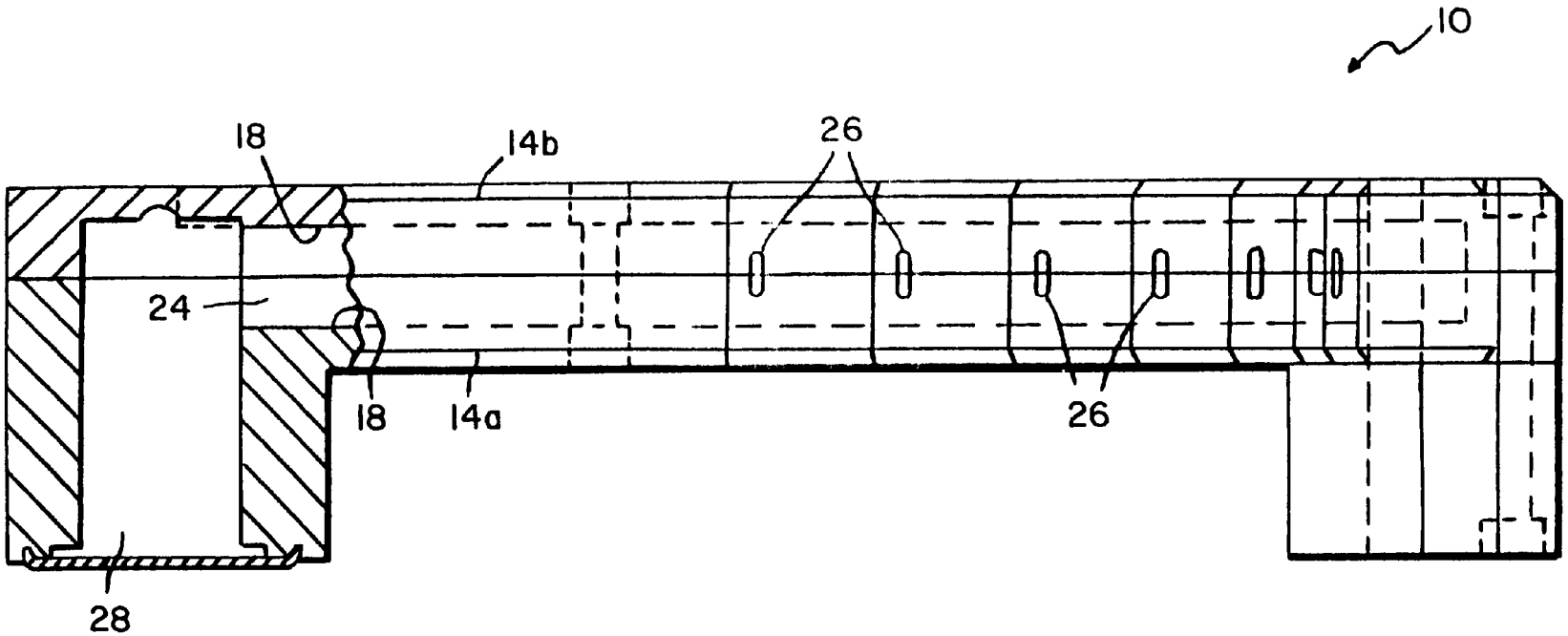
FIG. 4 is a bottom view of the coolant delivery device.

With reference initially to FIGS. 1–4, a coolant delivery device in accordance with the present invention is generally depicted at 10 at a location adjacent to a work roll 12. As the work roll undergoes normal wear, it will be progressively ground down to a reduced diameter indicated at 12', at which time it will be discarded.

The cooling device comprises a housing having a generally concave scalloped inner edge 13 configured and dimensioned to partially surround the surface of work roll 12. The housing is subdivided into two mating half sections 14*a,* 14*b* held together by any convenient means such as for example the screws 16 shown in the drawings. The abutting interior surfaces of the half sections 14*a,* 14*b* each have a manifold groove 18 with branch grooves 20 leading the a scalloped inner edge 13.

The manifold grooves 18 coact in a confronting relationship to define a manifold conduit 24, and the branch grooves 20 coact in a confronting relationship to define delivery nozzles 26 arranged at appropriate angles selected to achieve optimum cooling of the roll 12.

A fluid coolant, which can be a liquid and/or a gas, is fed to the manifold conduit 24 via an inlet port 28 in half section 14*a,* and is then delivered to the roll surface via nozzles 26.

The concave inner edge 13 is formed on a generally arcuate first position "A" of the housing, and a generally arcuate oppositely curved portion "B" of the housing has a convex inner edge 25 providing a continuation of the edge 13. The housing portions A, B are provided, respectively, with generally hook-shaped ends defining notches 30*a,* 30*b*. Bolts 32*a,* 32*b* extend through the notches 30*a,* 30*b* and serve to secure the coolant delivery device to the roll stand structures 34. Notch 30*a* is somewhat deeper than notch 30*b*. Thus, by loosening the bolts 32*a,* 32*b,* the device can be pivotally adjusted about the axis of bolt 32*b* to accommodate the different roll diameters resulting from progressive roll grinding. Loosening of the bolts 32*a,* 32*b* also allows the device to be easily and quickly removed for replacement by another new or refurbished unit.

Figure 5:
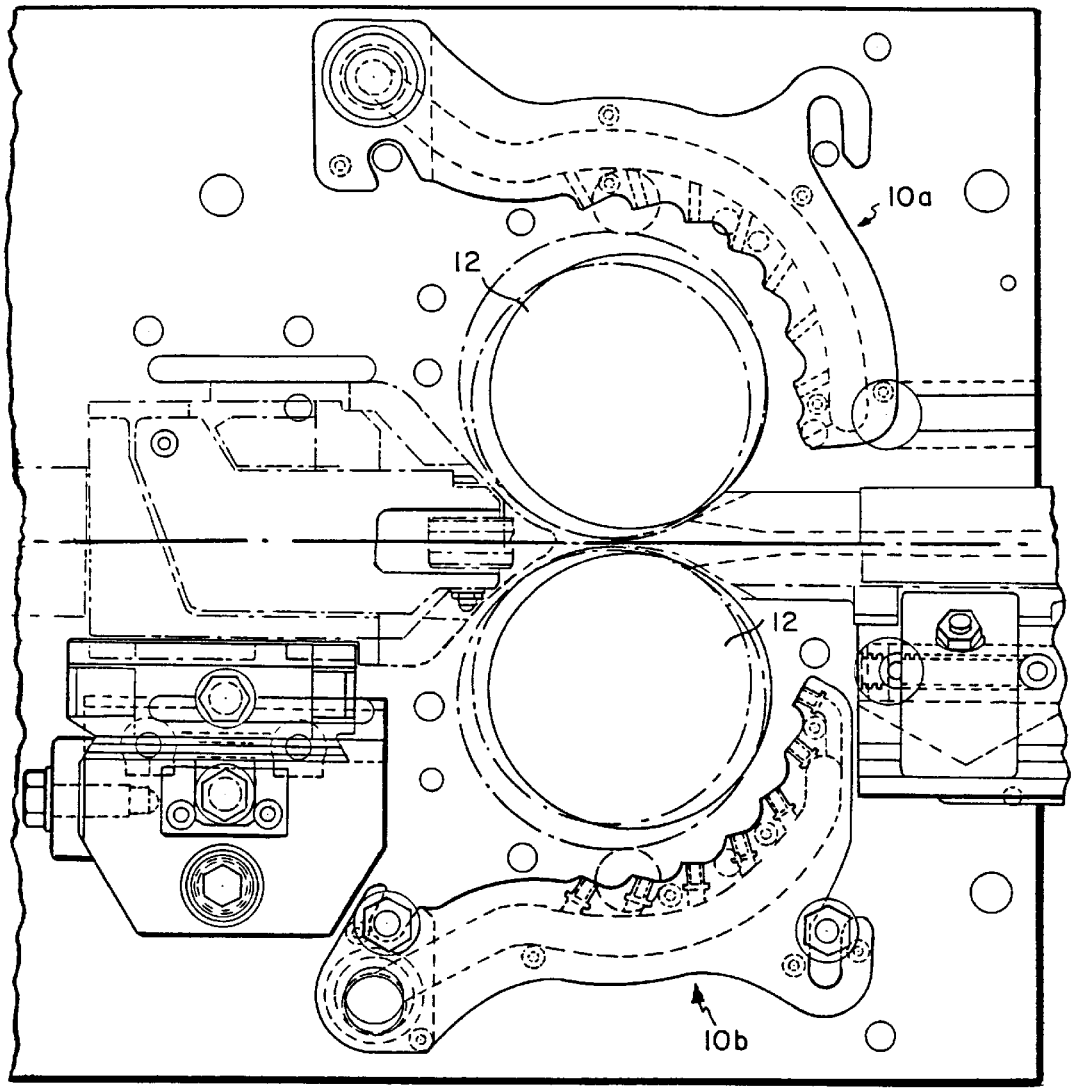
FIG. 5 is a side view of a typical installation in which two coolant delivery devices are positioned respectively above and below a pair of work rolls.

FIG. 5 depicts an installation of two coolant devices 10*a,* 10*b,* one being a mirror image of the other, and each being positioned adjacent to one of a pair of work rolls 12.

By dividing the delivery device into two mating half sections, it can be produced easily on common machinery with readily available tools, e.g., basic modern three axis milling machines. Much more freedom can be enjoyed in choosing the number of delivery nozzles, as well as their location, and angular disposition, without unnecessarily increasing the cost of the device. The cross sectional configuration of the delivery nozzles can be varied with considerable freedom, including for example cross, oval, T-shape, or diamond cross sections. The delivery nozzles can also be located above, at or below, the centerline of the manifold conduit to achieve a wide pattern of coolant delivery. Replaceable inserts for the nozzles and/or a liner for the manifold conduit is also a design option.

Choice of materials is greatly expanded in comparison to conventional pipe-like devices. Material selection need not be limited to that which can withstand bending, machining and welding. The device of the present invention can readily be made from many different materials including metal plate, cast metal, plastic, ceramic, or composite materials. Thus, in a rolling mill environment where cooling water can often have entrained abrasive particles, an abrasion resistant material can be used. If the cooling water contains minerals that can adhere to passage walls, a non-stick lining or coating can be applied to interior surfaces. Corrosion-resistant coating may also be employed where appropriate.

The geometry of the manifold conduit can also be varied to provide each delivery nozzle with near equal pressure, thereby further optimizing coolant delivery.

The device can easily be disassembled for cleaning and replacement of internal liner components where utilized.

I claim:

1. Apparatus for applying a fluid coolant to the surface of rotating work roll in a rolling mill, said apparatus comprising:

a housing having a generally concave inner edge configured and dimensioned to partially surround the surface of the work roll, said housing being subdivided into mating half sections having abutting interior surfaces;

first grooves in said interior surfaces arranged in a confronting relationship to define a manifold conduit;

second grooves in said interior surfaces arranged in a confronting relationship to define nozzle conduits leading from said manifold conduit to said concave inner edge; and an inlet in said housing through which a fluid coolant may be fed to said manifold conduit for application via said nozzle conduits to the surface of the work roll.

2. The apparatus of claim 1 wherein said concave inner edge has a scalloped configuration.

3. The apparatus as claimed in claim 1 wherein said concave inner edge is formed on a generally arcuate first portion of said housing.

4. The apparatus as claimed in claim 3 wherein said housing has a generally arcuate oppositely curved second portion with a convex inner edge providing a continuation of said concave inner edge.

5. The apparatus as claimed in claim 4 wherein said first and second housing portions are provided, respectively, with first and second notches configured and dimensioned to receive and coact in mechanical interengagement with fasteners serving to secure said housing to a support structure.

6. The apparatus as claimed in claim 5 wherein the depth of said first notch is greater than the depth of said second notch to thereby accommodate pivotal adjustment of said housing about the fastener received in said first notch.

* * * * *